US009834985B2

(12) United States Patent
Storen et al.

(10) Patent No.: US 9,834,985 B2
(45) Date of Patent: Dec. 5, 2017

(54) PANEL ASSEMBLY

(71) Applicant: Reliance Doors Pty Ltd, Pinkenba, Queensland (AU)

(72) Inventors: Nicholas Storen, Coorparoo (AU); Stuart Steele, Spring Mountain (AU)

(73) Assignee: Reliance Doors Pty Ltd, Pinkenba, Queensland (AU)

( * ) Notice: Subject to any disclaimer, the term of this patent is extended or adjusted under 35 U.S.C. 154(b) by 0 days.

(21) Appl. No.: 15/027,452

(22) PCT Filed: Oct. 20, 2014

(86) PCT No.: PCT/AU2014/050296

§ 371 (c)(1),
(2) Date: Apr. 6, 2016

(87) PCT Pub. No.: WO2015/058256

PCT Pub. Date: Apr. 30, 2015

(65) Prior Publication Data

US 2016/0237744 A1 Aug. 18, 2016

(30) Foreign Application Priority Data

Oct. 21, 2013 (AU) ..... 2013904060

(51) Int. Cl.
*E06B 9/58* (2006.01)
*E06B 9/06* (2006.01)
(Continued)

(52) U.S. Cl.
CPC ..... *E06B 9/581* (2013.01); *E06B 9/0638* (2013.01); *E06B 9/13* (2013.01); *E06B 9/15* (2013.01);
(Continued)

(58) Field of Classification Search
CPC ..... E06B 9/581; E06B 9/13; E06B 9/17076; E06B 2009/135; E06B 2009/1594; E06B 2009/1577
(Continued)

(56) References Cited

U.S. PATENT DOCUMENTS 137,595 A * 4/1873 Clark ..... E06B 9/13 160/264
184,944 A * 11/1876 Wilson ..... E06B 9/13 16/197
(Continued)

FOREIGN PATENT DOCUMENTS

| | | | |
|---|---|---|---|
| AU | 765455 | 1/2001 | |
| GB | 2137271 | 10/1984 | |
| GB | 2137271 A * | 10/1984 | ..... E05D 3/00 |

OTHER PUBLICATIONS

Written Opinion and International Search Report for International Application No. PCT/AU2014/050296, dated Nov. 21, 2014.

*Primary Examiner* — Blair M Johnson
(74) *Attorney, Agent, or Firm* — Warner Norcross and Judd, LLP

(57) ABSTRACT

A panel assembly including a panel that can be positioned in an opening, the panel including a plurality of locking members spaced apart along at least part of a length of and proximate to opposing longitudinal edges of the panel and a guide extending along either side of the opening, each guide including at least one locking flange extending along at least part of a length of the guide, wherein in use the panel is received in the guides so that the locking members selectively engage the flanges to limit lateral movement of the panel edges.

22 Claims, 7 Drawing Sheets

(51) Int. Cl.
*E06B 9/15* (2006.01)
*E06B 9/13* (2006.01)
*E06B 9/17* (2006.01)

(52) U.S. Cl.
CPC .... *E06B 9/17076* (2013.01); *E06B 2009/135* (2013.01); *E06B 2009/1516* (2013.01); *E06B 2009/1577* (2013.01)

(58) Field of Classification Search
USPC ..... 160/133, 273.1
See application file for complete search history.

(56) References Cited

U.S. PATENT DOCUMENTS 296,373 A * 4/1884 Wilson ..... E06B 9/13 160/229.1
1,918,415 A 7/1933 Miller
2,350,287 A * 5/1944 Michelman ..... E06B 9/13 160/133
2,839,135 A 6/1958 Anderson
3,489,200 A * 1/1970 Recchione ..... E05D 15/24 160/133
4,219,067 A * 8/1980 Hurst ..... E05F 7/04 16/404
4,234,033 A * 11/1980 Leivenzon ..... E06B 9/17046 160/133
4,649,981 A * 3/1987 Bibeau ..... E06B 9/581 160/120
4,976,168 A * 12/1990 Lotznicker ..... E06B 9/74 160/310
5,056,579 A * 10/1991 Krafutler ..... E06B 9/581 160/264
5,058,651 A * 10/1991 Ashley ..... E06B 9/581 160/271
5,253,694 A * 10/1993 Bernardo ..... E06B 9/581 160/133
5,964,271 A * 10/1999 Lapointe ..... E06B 9/581 160/264
6,068,040 A 5/2000 Magro et al.
2004/0163773 A1* 8/2004 Murray ..... E06B 9/08 160/133
2005/0211391 A1 9/2005 Varley et al.

* cited by examiner

Fig. 6A
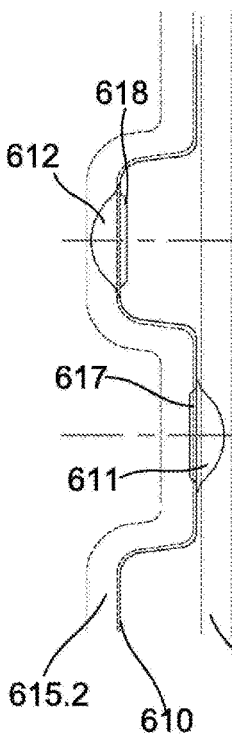
Fig. 6B
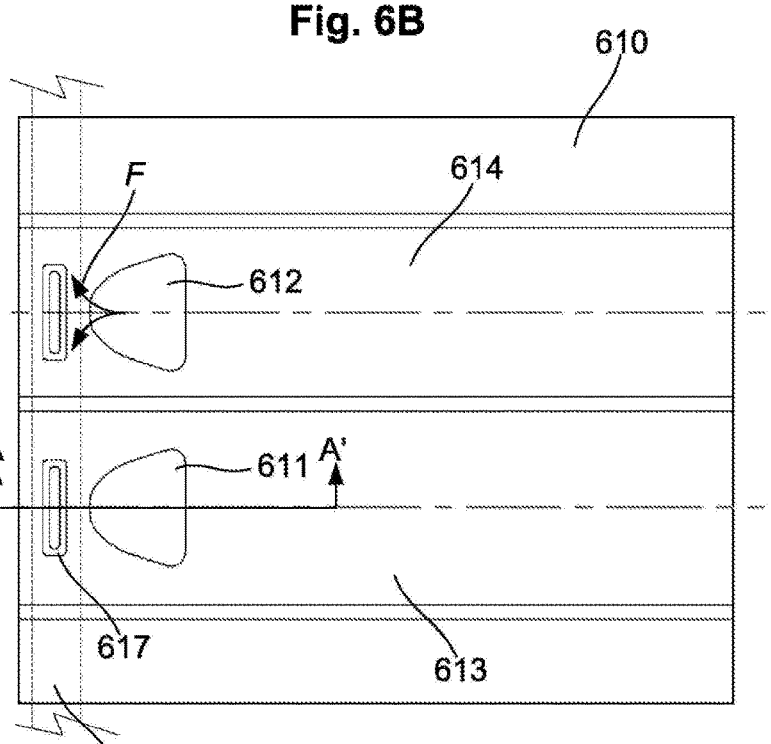
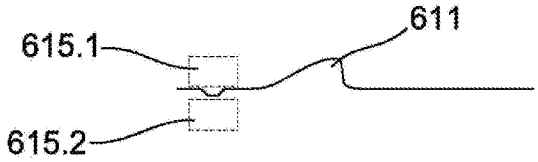
Fig. 6C
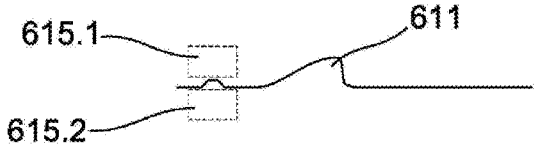
Fig. 6D

Fig. 7A
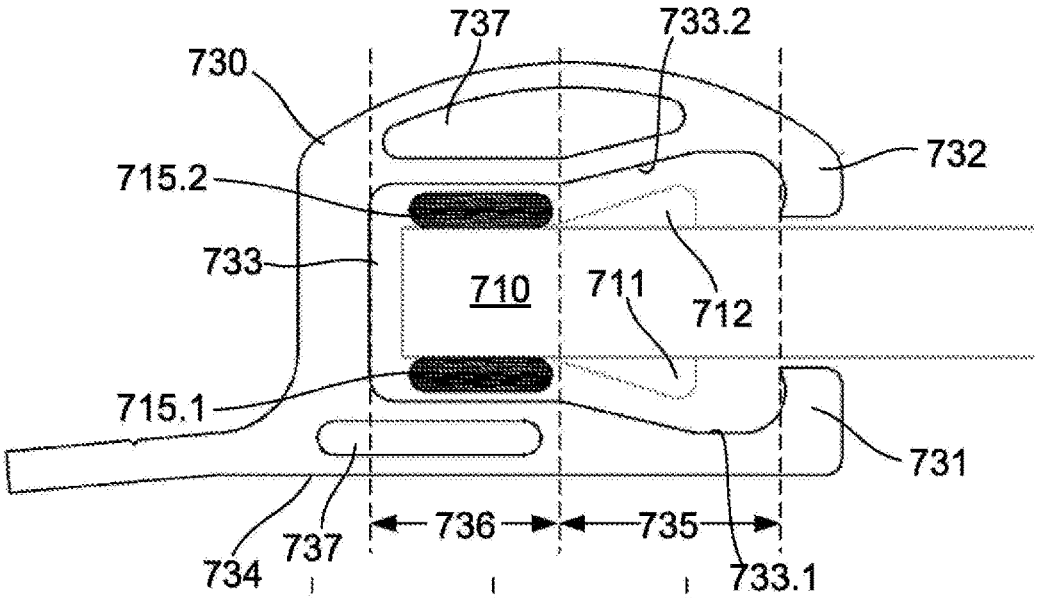
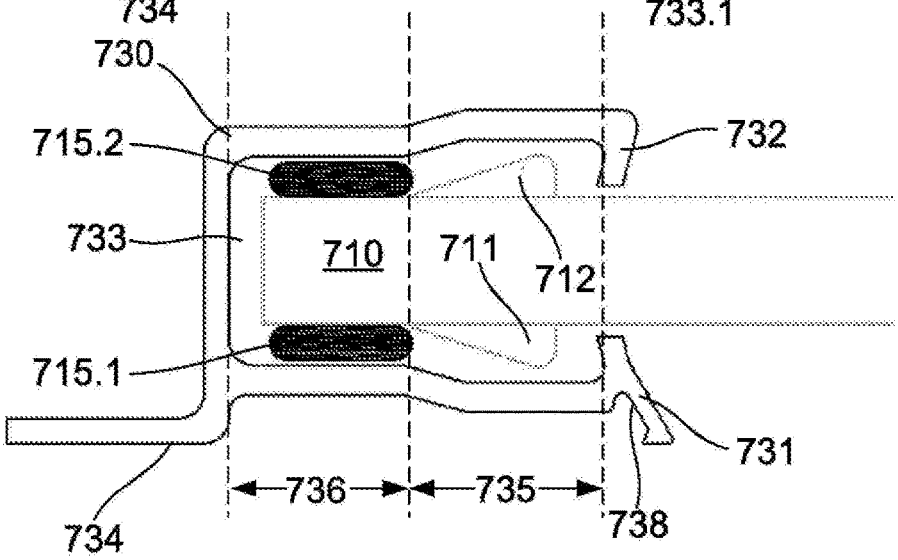
Fig. 7B

PANEL ASSEMBLY

BACKGROUND OF THE INVENTION

The present invention relates to a panel assembly and in one particular example to a panel assembly including a wind lock mechanism.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

It is known to provide roller doors including wind locking for industrial purposes. However typically these arrangements have not been used in domestic environments. This is for a number of reasons, including the robust construction of the industrial designs, making these too expensive for domestic applications, and generally too heavy for manual operation, or operation using domestic rated drive mechanisms.

SUMMARY OF THE PRESENT INVENTION

In one broad form the current embodiments seek to provide a panel assembly including:

a) a panel that can be positioned in an opening, the panel including a plurality of locking members spaced apart along at least part of a length of, and proximate to opposing longitudinal edges of the panel; and, b) a guide extending along either side of the opening, each guide including at least one locking flange extending along at least part of a length of the guide, wherein in use the panel is received in the guides so that the locking members selectively engage the flanges to limit lateral movement of the panel edges.

Typically the locking members extend outwardly from at least one of front and rear faces of the panel.

Typically the locking members include front and rear locking members extending outwardly from front and rear faces of the panel, respectively.

Typically each guide includes front and rear flanges that in use selectively engage the front and rear locking members respectively.

Typically each guide includes a channel having front and rear faces, the front and rear flanges extending inwardly from the front and rear faces.

Typically the panel includes a corrugated profile defining peaks and troughs, and wherein the locking members extend outwardly from at least one of the peaks and the troughs.

Typically the peaks have different widths to the troughs.

Typically the locking members are defined by deformation of the panel.

Typically the deformation at least one of:

a) does not create an opening in the panel material, and b) provides a continuous surface.

Typically the panel includes a strengthening member positioned between at least some of the locking members and an edge of the panel.

Typically the strengthening member is at least one of a channel and a ridge extending generally parallel to an edge of the panel.

Typically the panel includes a edging strip extending along at least part of the opposing longitudinal edges of the panel.

Typically the edging strip includes at least one polymeric strip.

Typically the edging strip includes first and second strips mounted on front and rear faces respectively.

Typically the edging strip projects above an extent of the locking members.

Typically the guide includes a channel for receiving the edging strip and locking members, and wherein an edging strip clearance between the edging strip and the channel is less than at least one of:

a) a locking member clearance between the locking members and the channel; and, b) a flange clearance between the panel and flanges of the channel.

Typically each guide includes:

a) a first channel portion that receives the locking members of the panel; and, b) a second channel portion that receives edging strips of the panel, wherein the second channel portion is narrower than the first channel portion.

Typically the guide is made of at least one a aluminium and steel.

Typically the panel is a continuous panel.

Typically the panel is a door curtain movable between a retracted position and an extended position in which the door curtain covers the opening.

Typically the panel assembly includes a drive assembly that moves the panel between retracted and extended positions.

Typically the drive assembly includes:

a) a roller assembly rotatable mounted relative to a mounting bracket, and b) a drive for rotating the roller assembly, such that in the retracted position the panel is coiled around the roller assembly.

Typically the locking members are spaced from the flanges by a distance of between 5 mm and 40 mm at rest.

In another broad form the embodiments herein seek to provide a door assembly including:

a) a door curtain movable between a retracted position and an extended position in which the door curtain covers an opening, the door curtain including a plurality of locking members spaced apart along at least part of a length of, and proximate to opposing longitudinal edges of the panel; and, b) a guide extending along either side of an opening, each guide including at least one locking flange extending along at least part of a length of the guide, wherein in use the panel is received in the guides so that the locking members selectively engage the flanges to limit lateral movement of the door curtain edges.

These and other objects, advantages, and features of the invention will be more fully understood and appreciated by reference to the description of the current embodiment and the drawings.

Before the embodiments herein are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

BRIEF DESCRIPTION OF THE DRAWINGS

FIG. 6A is a schematic end view of a further example of part of a panel;

FIG. 6B is a schematic front view of part of the panel of FIG. 6A;

FIG. 6C is a schematic cross sectional view along the line A-A' of FIG. 6B;

FIG. 6D is a schematic cross sectional view of a modified version of the panel of FIG. 6C;

FIG. 7A is a schematic end view of a further example of a guide; and,

FIG. 7B is a schematic end view of a further example of a guide.

DETAILED DESCRIPTION OF THE PREFERRED EMBODIMENTS

Figure 1B:
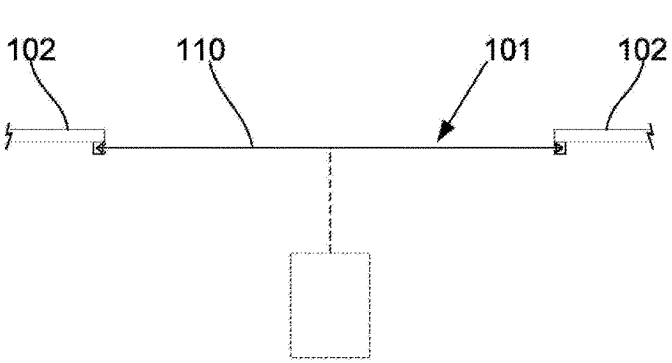
FIG. 1B is a schematic plan view of the panel assembly of the FIG. 1A.

An example of a panel assembly will now be described in more detail with reference to FIGS. 1A to 1C.

In this example, the panel assembly 100 includes a panel 110 that can be positioned in an opening. The opening may be of any suitable form, depending on the application. In one example, the opening is defined by walls 102, for example forming part of a domestic dwelling or other building, and could therefore include a garage door opening, window opening, or similar, with the panel acting as a door, window, or the like. Alternatively, however, the opening could be in a fence, with the panel being a fence panel, or the like.

The panel 110 includes a number of locking members 111, 112 spaced apart along at least part of a length of and proximate to opposing longitudinal edges of the panel 110. In this example, locking members 111, 112 are provided on front and rear faces on 110.1, 110.2 of the panel 110. However, this is for the purpose of example only and is not essential, although as described in more detail below is generally a preferred arrangement.

The panel assembly 100 further includes a guide 130 extending along either side of the opening 101. Each guide 130 includes at least one locking flange 131, 132, with two being shown in this example. The locking flanges 131, 132 extend along at least part of the length of the guide 130, wherein in use the panel 110 is received in the guide 130 so that the locking members 111, 112 selectively engage with the flanges 131, 132 to thereby limit lateral movement of panel edges.

In particular, this arrangement prevents the panel moving laterally relative to the guides 130, which can in turn prevent the panel disengaging from the guides 130, for example under conditions of load applied to the faces of the panel. This thereby operates to act as a wind lock, preventing the panel 110 being decoupled from the guides 130 under wind induced loads, whilst also acting to provide a security feature avoiding the panel being opened or removed by pressure applied to a face of the panel.

The locking members are typically spaced apart along a length of opposing longitudinal edges of the panel so that the panel is secured to the guides along at least most of its length, thereby maximising the degree of locking provided. In the case of the panel being a roller door, maximum locking will be achieved when the door is in its fully extended position, which in turn corresponds to the circumstance when loads against the door are maximised due to the increased exposed face area of the door.

In one example, the panel 110 is a continuous panel formed from a continuous metal sheet or other similar material, with the locking members being produced by dimples, recesses, push-outs, cut-outs or the like, within the panel material. This makes the locking mechanisms easy to produce, for example during roll or press forming of the panel, making it possible to implement the wind lock arrangement relatively cheaply. Furthermore, this can be performed in lightweight materials. This makes the arrangement suitable for use in a wide variety of circumstances and is particularly suited for roller door assemblies for manual use or use with low powered motors, making the arrangement feasible for use in domestic scenarios, which has not previously been the case.

A number of further features will now be described.

In the current example, front and rear locking members 111, 112 extend outwardly from the front and rear faces 110.1, 110.2 of the panel, in which case front and rear flanges 131, 132 are provided as part of the guide to engage the front and rear locking members 111, 112 respectively. Whilst the use of front and rear locking members 111, 112, and corresponding front and rear flanges 131, 132 is not essential, it will be appreciated that this significantly enhances the strength of the locking effect. This is in turn allows a sufficient degree of locking to be obtained with lightweight materials, such as aluminium, making the panel assembly particularly suited for use in domestic environments, although other materials, such as steel or the like could be used. However, as mentioned above, this is not essential and alternatively locking members may be provided only a single face only such as the front or rear face only, in which case only a single corresponding flange 131, 132 may be provided on the guide 130.

In one example, each guide 130 includes a channel 133 which includes front and rear faces 133.1, 133.2 with the front and rear flanges 131, 132 extending inwardly from the front and rear faces, although any appropriate arrangement can be used.

The panel 110 typically includes a corrugated profile defining peaks and troughs, and with the locking members extending outwardly from at least one of the peaks and the troughs. For example, front locking members 111 will extend outwardly from peaks in the front face, whilst rear locking members 112 extend outwardly from troughs in the front face (corresponding to peaks in the rear face), thereby maximising the front-to-back distance between the tips of the front and rear locking members 111, 112, in turn maximising the strength of the locking mechanism.

In one example, the peaks can have different widths to the troughs. This is not essential, but the use of different sized peaks, and in particular larger peaks in the front face, can have a number of benefits. For example, this can make the panel easier to roll, by having the narrower troughs on the inside of the roll, in the event that this forms part of a roller door assembly. Additionally, the larger peaks in the front face can be useful for accommodating locking mechanisms, or the like, as well as being more visually appealing.

As mentioned above, the locking members can be defined in any appropriate manner, but preferably are defined by deformation of the panel, for example during part of a roll forming process. More preferably, the deformation does not create an opening or discontinuity in the panel material so that the deformation provides a continuous surface. This is done to avoid the creation of sharp edges, which can be a hazard both during installation of the panel and subsequently, for example in the event that the locking members project outwardly from the guide. Edges can also the locking members to catch, for example on edges of the guide or flanges, or on other locking members when panels are rolled up.

The panel can also include a strengthening member positioned between at least some of the locking members and an edge of the panel. This can act to provide additional strength, and in particular prevent the panel deforming along the edge of the panel under load, which can in turn result in failure of the locking members. The strengthening member can be of any appropriate form, but in one example includes either a channel or ridge extending generally parallel to an edge of the panel. This allows the strengthening member to be formed by deformation of the panel, for example during a roll forming process or the like, allowing this to be performed at the same time as creating the locking members. The presence of the channel or ridges ensures that forces created by action of the locking member on the guide are dissipated along the edge of the panel and are not focussed at individual locations on the panel edge, which can in turn lead to deformation of the panel material, and hence collapsing and failure of the locking members.

In one example, the panel 110 includes at least one edging strip extending along at least a part of the opposing longitudinal edges of the panel 110. More typically the panel 110 includes first and second strips mounted on front and rear faces of the edge of the panel. In general, the edging strip(s) will typically be at least partially resilient and act to absorb impacts thereby maintaining quiet operation of the door under windy conditions.

The guide typically includes a channel for receiving the edging strip and locking members, and wherein an edging strip clearance between the edging strip and the channel is less than at least one of a locking member clearance between the locking members and the channel and a flange clearance between the panel and flanges of the channel. To achieve this, each guide can include a first channel portion that receives the locking members of the panel and a second channel portion that receives edging strips of the panel, wherein the second channel portion is narrower than the first channel portion. This ensures that when the panel is under lateral load, the edging strip is brought into contact with the guide before either the panel or the locking members, thereby minimizing noise.

In one example, the edging strip(s) can extend outwardly from the door by a distance greater than that of the locking members 111, 112, so that the edging strip projects above an extent of the locking members. This can be used to ensure that the locking members 111, 112 do not abut or impact against internal faces of the guides, other than the flanges 131, 132, which can in turn lead to rattling and other undue noise. Thus, the edging strips operate to minimise noise created by wind or other loads applied to the panel 110. This also prevents the locking members fouling with each other in the event that the panel is rolled up, such as in the case of a roller door.

Additionally, the edging strip(s) can operate to provide a low friction face that abuts against inside faces of the guide to facilitate raising and lowering of the panel. Accordingly, the edging strip(s) can be formed from any suitable material, and in one example, are formed from polymeric materials, brush strips, or the like.

In one example the panel is a continuous panel although this is not essential, and alternatively shuttered panels could be used.

In one example, the panel assembly is part of a roller door assembly, with the panel being a door curtain movable between a retracted position and an extended position in which the door curtain covers the opening.

In this instance, the door assembly 100 may further include a drive assembly 120 that moves the panel 110 between the retracted and extended positions. The drive assembly may be any form of drive assembly and could include for example a linear actuator, such as a garage door drive, or a roller assembly and associated drive, an example which will be described in more detail below. In one example the drive assembly includes a roller assembly and a drive for rotating the roller assembly although again other arrangements can be used. However, this is not essential and alternatively the door can be operated, typically by lifting or lowering the panel, manually.

Figure 2B:
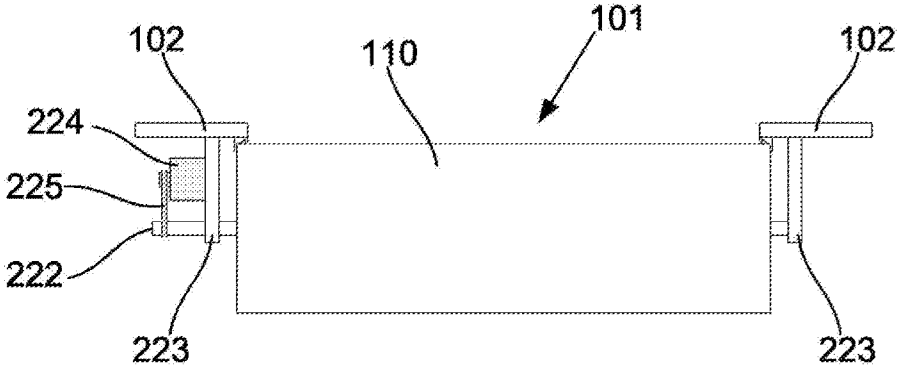
FIG. 2B is a schematic plan view of the roller door assembly of FIG. 2A.
Figure 2A:
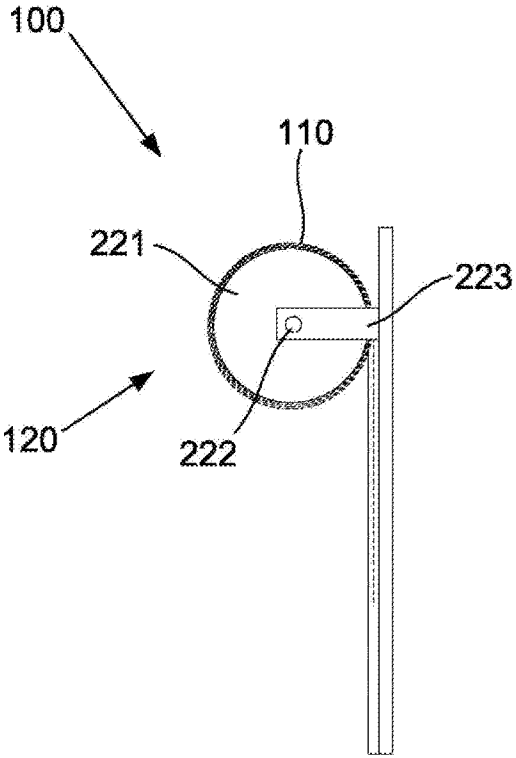
FIG. 2A is a schematic side view of a second example of a roller door assembly.

An example of a door assembly will now be described with reference to FIGS. 2A and 2B.

In this example, additional details of an example drive assembly 120 are shown. In this example, the drive assembly 120 includes a roller assembly including a mounting drum 221 coupled to an axle 222 which is rotatably supported by mounting brackets 223 coupled the walls 102. One of the brackets 223 further supports a drive 224, which is coupled to the axle 222 via a transmission, such as a belt or chain 225 and sprocket arrangement. In use the motor 224 operates to rotate the axle 222 causing corresponding rotation of the drum 221, allowing the door curtain 110 to be moved between the extended and retracted positions as will be appreciated by persons skilled in the art. It will, also be appreciated that the motor may be omitted, allowing the door curtain to be raised or lowered manually. In this instance, a spring may be used to bias the axle 222, thereby offsetting the weight of the door curtain 110, making lifting and lowering of the door curtain easier, as will be appreciated by persons skilled in the art.

However, any suitable drive assembly may be used and in another example, the motor can be integrated internally within the axle, as will be appreciated by persons skilled in the art.

A further example panel assembly will now be described with reference to FIGS. 3A to 3F. In this example, reference numerals increased by 200 are used to denote similar features to those shown in FIGS. 1A to 1C.

In this example, the panel 310 includes front and rear locking members 311, 312 positioned proximate opposing edges of the panel 310. An edging strip 315 is also mounted on each of the opposing edges, as shown. In this example, the panel 310 includes peak 313 and troughs 314, which extend laterally across the panel 310 with the front locking members 311 projecting outwardly from the peaks 313 and the rear locking members 312 projecting outwardly from the troughs 314. As previously mentioned, this maximises the lateral separation between the tips of the front and rear locking members 311, 312 maximising the strength of the locking effect provided.

Figure 3A:
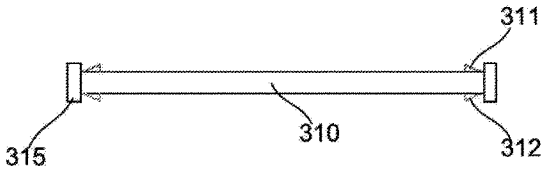
FIG. 3A is a schematic plan view of an example of a panel.
Figure 3D:
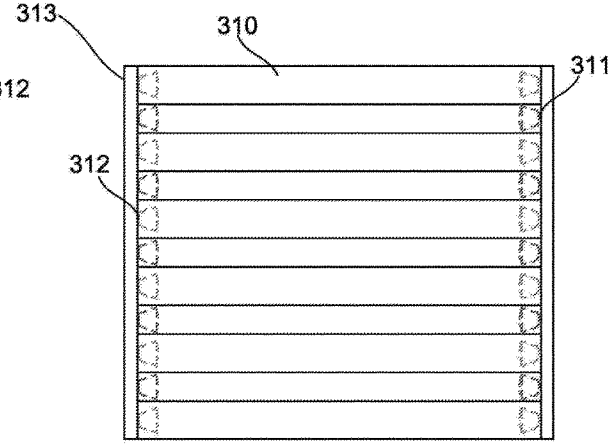
FIG. 3D is a schematic front view of the panel of FIG. 3A.
Figure 3C:
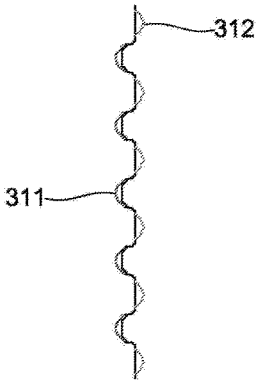
FIG. 3C is a schematic side view of the panel of FIG. 3A.
Figure 3B:
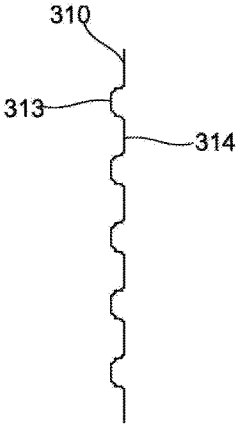
FIG. 3B is a schematic side view of the panel of FIG. 3A with the locking members omitted.
Figure 3E:
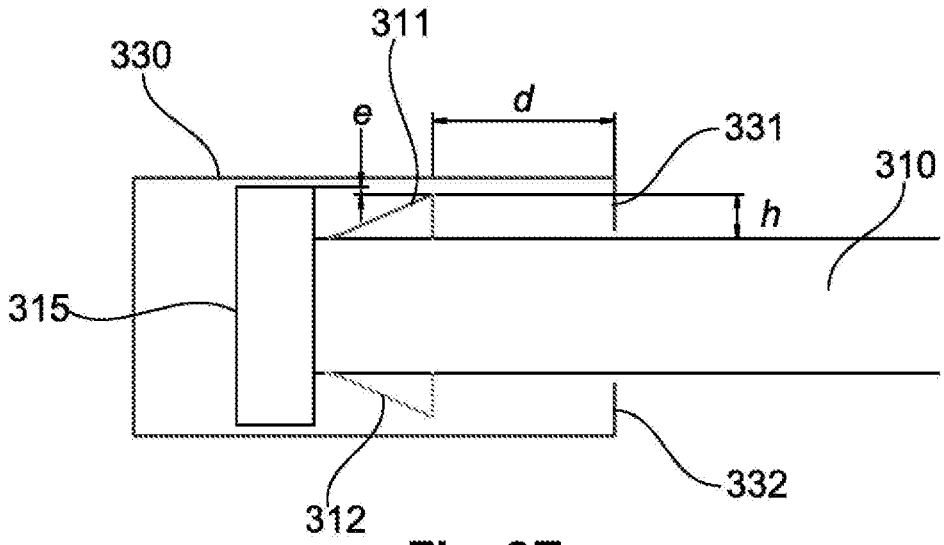
FIG. 3E is a schematic plan close up view of the panel of FIG. 3A positioned in a guide.

As shown in FIG. 3E, the locking members 311, 312 project from faces of the panel 310 a height h, which is smaller than the extent of the edging strip 315 so that the edging strip 315 projects a distance e above a locking member. This ensures that should front-to-back movement of the panel occur, the edging strip 315 will impact on the guide 330 thereby minimising generated noise. This also prevents locking members fouling on each other in the event that the panel is rolled up, for example when used as part of a roller door assembly.

As also shown in this example, the locking members 311, 312 at rest (i.e. while the panel is not subject to load) are typically separately from the flanges 331, 332 of the guide 330 by a distance d so that at least some lateral movement of the panel ends can be accommodated before the locking members 311, 312 engage the corresponding flanges 331, 332. This helps minimise noise generated through the application of force to the panel, whilst also helping to prevent jamming of the door in use in one example, the distance d is greater than 5 mm and less than 40 mm and preferably less than 30 mm, with the exact distance selected depending on factors such as the expected loads on the panel, the panel strength, the intended application, or the like.

Figure 3F:
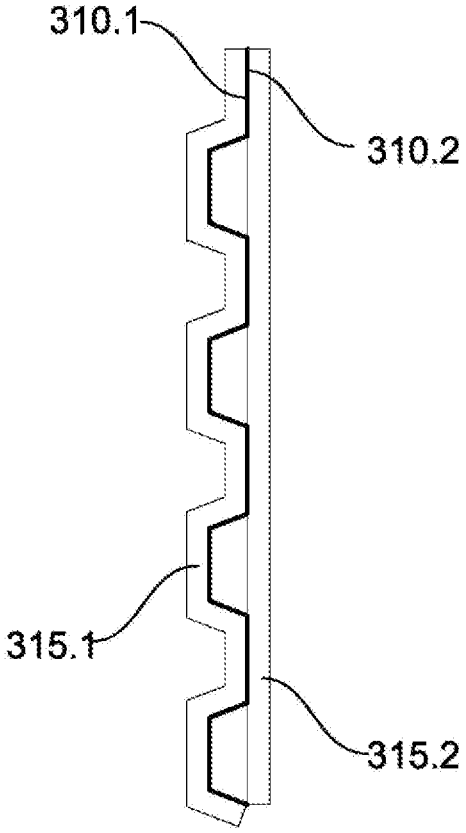
FIG. 3F is a schematic side view of the panel of FIG. 3A including edging strips.

As further shown in FIG. 3F, the edging strips 315 can be mounted in a variety of ways. In this example, the edging strip 315 includes a front strip 315.1, which generally conforms to the front face 310.1 of the panel so that the front edging strip 315.1 follows the peaks and troughs 313, 314 in the panel. In contrast, a rear edging strip 315.2 extends across the rear face 310.2 in a substantially straight fashion, so that the rear edging strip 315.2 extends between the troughs, separated from the underside of the peaks 313. The edging strips can be attached in any suitable manner, such as by stapling, riveting, adhesive, or any other suitable fastener.

Figure 4:
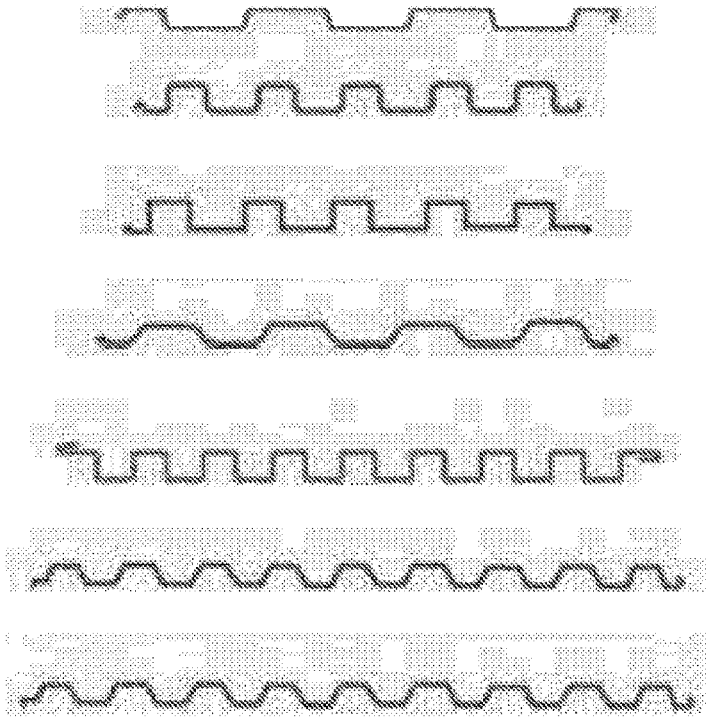
FIG. 4 is a schematic diagram illustrating different profiles of panel.

It will be appreciated that the above described arrangement can be used with a variety of panel configurations and example cross sectional corrugation profiles as shown in FIG. 4.

Figure 5A:
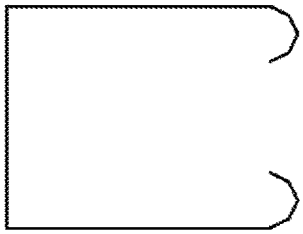
FIG. 5A is a schematic plan view of an alternative guide arrangement.
Figure 5B:
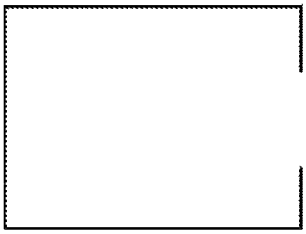
FIG. 5B is a schematic plan view of another alternative guide arrangement.
Figure 5C:
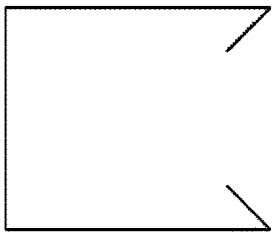
FIG. 5C is a schematic plan view of yet another alternative guide arrangement.

Furthermore, a variety of different guide shapes can be used as shown in FIGS. 5A to 5C. In the example of FIG. 5A the flanges are curved inwardly towards the guide to maximise the retaining force provided by the flanges, whilst in the example of FIG. 5C a restraint can be provided to prevent the guide from opening up while the panel is under load. This can be achieved by shaping of the flanges, or alternatively through the use of additional retraining members, lugs or the like.

It will be appreciated from the above, that in one particular example, the panel is a door panel forming part of a door assembly. However, this is not intended to be limiting and in practice the panel could be any form of panel member, such as a window, fence, security panel, or the like.

A further example panel assembly will now be described with reference to FIGS. 6A to 6C. In this example, reference numerals increased by 300 are used to denote similar features to those shown in FIGS. 3A to 3D.

In this example, the panel 610 includes front and rear locking members 611, 612, which in practice would be positioned proximate opposing edges of the panel 610, with only one edge being shown in this example. In this example, the panel 610 includes peaks 613 and troughs 614, which extend laterally across the panel 610 with the front locking members 611 projecting outwardly from the peaks 613 and the rear locking members 612 projecting outwardly from the troughs 614. As previously mentioned, this maximises the lateral separation between the tips of the front and rear locking members 611, 612 maximising the strength of the locking effect provided.

Front and rear edging strips 615.1, 615.2 are mounted on each of the opposing edges, as shown, with this typically being performed by stapling the edging strips 615.1, 615.2 to the peaks 613, with the front edging strips extending substantially linearly and bridging the troughs 614, whilst the rear edging strip 615.2 follows the profile of the rear of the panel. This is for the purpose of example only and allows the amount of edging strip material to be minimised, whilst simplifying the fixing arrangement although it will be appreciated any suitable arrangement could be used.

In this example, strengthening members 617, 618 are provided between the locking members 611, 612 and the respective edge of the panel 610. The strengthening members are in the form of channels and/or ridges and causes forces F generated along the crest of the locking members (caused by wind loading or other similar forces) to be dissipated along the length of the panel, edge, rather than focusing these on a specific part of the panel, thereby reducing the likelihood of panel failure.

In one example, the strengthening members are directed in an opposing direction to the locking members, as shown for example in FIG. 6C, but alternatively they could be provided in the same direction as shown in FIG. 6D. This has the added benefit of raising the edging strip, thereby ensuring the edging strip projects beyond the extent of the locking member (i.e. the distance e in FIG. 3E is greater than 0).

Figure 1C:
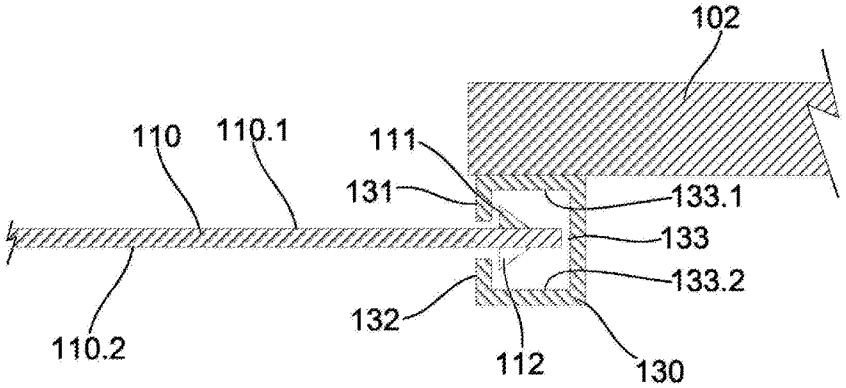
FIG. 1C is a schematic cross section view through line A-A of FIG. 1A.
Figure 1A:
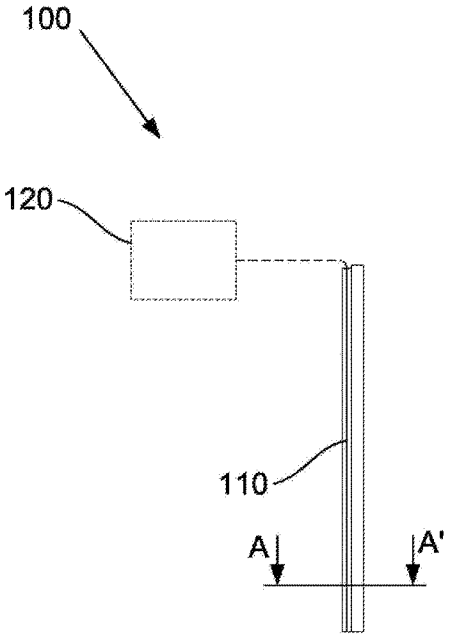
FIG. 1A is a schematic side view of a first example of a panel assembly.

Example guides are shown in FIGS. 7A and 7B, with reference numerals similar to those used in FIG. 1C, increased by 600.

In these examples, the guides 730 include a channel 733 and front and rear flanges 731, 732. The guide also includes a surface 734 allowing the guide to be mounted to a wall or other surface, for example in a manner similar to that shown in FIG. 1C.

In this example, the channel includes first and second channel portions 735, 736, denoted by the dotted lines. The first channel portion 735 is wider than the second channel portion 736, to accommodate the extent of the locking members 711, 712 of the panel 710. In this regard, the term wider refers to the distance between the front and rear channel faces 733.1, 733.2. As a result of this arrangement, the front and rear edging strips 715.1, 715.2 are located nearer the front and rear channel faces 733.1, 733.2 than the locking members 711, 712. This helps ensuring the front and rear edging strips 715.1, 715.2 abut against the front and rear channel faces 733.1, 733.2 when loaded, whilst also limiting the extent of front to back motion of the panel that can occur.

Additionally, the second channel member is sized so that even in the event that the locking members 711, 712 are engaging the flanges 731, 732, at least some of the front and rear edging strips 715.1, 715.2 remain within the second channel portion, so that front to back movement of the panel 710 is limited, which helps prevent the locking members 711, 712 decoupling from the flanges 731, 732.

The guides 730 are typically formed from an aluminium extrusion, although alternative steel or other suitable materials can be used. The examples of FIGS. 7A and 7B highlight a range of different guide configurations can be used, and it will be appreciated that the arrangements shown are therefore for the purpose of illustration and are not intended to be limiting.

For example, the flanges 731, 732 can extend at least partially inwardly to assist with engaging the locking members 711, 712. In the examples shown, the flanges 731, 732 are aligned, with the locking members 711, 712 being positioned a constant distance in from the edge of the panel 710. In this configuration, sideways movement of the panel 710 will cause the locking members 711, 712 to engage the flanges 731, 732 at generally the same time. However this is not essential, and either the locking members 711, 712 or the flanges 731, 732 could be offset. This could be performed so that the front locking members 711 and flanges 731 engage before the rear or front locking members 712 and flanges 732, or vice versa. This can be used to provide additional locking strength when the panel is deformed either inwardly or outwardly and could therefore be used to accommodate expected pressure differentials on either side of the panel.

The guide of FIG. 7A includes a number of voids to help reduce material volume and weight, whilst maintaining strength. Additionally, bracing members, or supporting brackets could be provided at different positions along the length of the guide. This can be performed to strengthen the guide and in particular prevent the flanges 731, 732 being urged apart, which could in turn lead to failure of the locking mechanism.

The guide of FIG. 7B include a clip arrangement 738, to allow this to engage with a mounting bracket on a wall to thereby facilitate installation, although any suitable installation arrangement could be used.

Accordingly, the above described arrangements provide panels including locking members that can engage with a guide to retain the panel in position, even during adverse lateral loading conditions, for example as experienced during wind loading. The panel can be made of lightweight materials, such as aluminium, sheet steel or the like and can include integrated loading members formed by deforming the panel, for example using a roll forming technique. This allows the panel to be profiled to include corrugations, thereby improving panel strength, as part of the same process as forming the locking members.

Further features can also be provided, such as edging strips to absorb impacts, ensure smooth movement of the panel when used as a roller door, and to space the panel when retracted into a rolled configuration. Strengthening members can be further integrated into the panel edges to further strengthen the panel against lateral loading, with these also being formed by deformation of the panel, so that these can also be created during the manufacturing process.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The claims defining the invention are as follows:

1. A panel assembly including:

a) a panel that can be positioned in an opening, the panel including a plurality of locking members spaced apart along at least part of a length of, and proximate to opposing longitudinal edges of the panel, wherein each locking member is a respective deformation of the panel; and, b) a guide extending along either side of the opening, each guide including at least one locking flange extending along at least part of a length of the guide, wherein in use the panel is received in the guides so that the locking members selectively engage the flanges to limit lateral movement of the panel edges; wherein at least one deformation of the panel is in the form of a detent defined by a first surface of the panel, wherein the detent is reflected as a push out on a second surface of the panel, the second surface being opposite the first surface.

2. A panel assembly according to claim 1, wherein the locking members extend outwardly from at least one of front and rear faces of the panel.

3. A panel assembly according to claim 1, wherein the locking members include front and rear locking members extending outwardly from front and rear faces of the panel, respectively.

4. A panel assembly according to claim 3, wherein each guide includes front and rear flanges that in use selectively engage the front and rear locking members respectively.

5. A panel assembly according to claim 4, wherein each guide includes a channel having front and rear faces, the front and rear flanges extending inwardly from the front and rear faces.

6. A panel assembly according to claim 1, wherein the panel includes a corrugated profile defining peaks and troughs, and wherein the locking members extend outwardly from at least one of the peaks and the troughs.

7. A panel assembly according to claim 6, wherein the peaks have different widths to the troughs.

8. A panel assembly according to claim 1, wherein each deformation at least one of:

a) does not define an opening in the panel; and, b) includes a continuous surface.

9. A panel assembly according to claim 1, wherein the panel includes a strengthening member positioned between at least some of the locking members and an edge of the panel.

10. A panel assembly according to claim 9, wherein the strengthening member is at least one of a channel and a ridge extending generally parallel to an edge of the panel.

11. A panel assembly according to claim 1, wherein the panel includes an edging strip extending along at least part of the opposing longitudinal edges of the panel.

12. A panel assembly according to claim 11, wherein the edging strip includes at least one polymeric strip.

13. A panel assembly according to claim 11, wherein the edging strip includes first and second strips mounted on front and rear faces respectively.

14. A panel assembly according to claim 11, wherein the edging strip projects above an extent of the locking members.

15. A panel assembly according to claim 11, wherein the guide includes a channel for receiving the edging strip and locking members, and wherein an edging strip clearance between the edging strip and the channel is less than at least one of:

a) a locking member clearance between the locking members and the channel; and, b) a flange clearance between the panel and flanges of the channel.

16. A panel assembly according to claim 15, wherein each guide includes:

a) a first channel portion that receives the locking members of the panel; and, b) a second channel portion that receives edging strips of the panel, wherein the second channel portion is narrower than the first channel portion.

17. A panel assembly according to claim 1, wherein the panel is a continuous panel.

18. A panel assembly according to claim 1, wherein the panel is a door curtain movable between a retracted position and an extended position in which the door curtain covers the opening.

19. A panel assembly according to claim 1, wherein the panel assembly includes a drive assembly that moves the panel between retracted and extended positions.

20. A panel assembly according to claim 19, wherein the drive assembly includes:

a) a roller assembly rotatably mounted relative to a mounting bracket; and, b) a drive for rotating the roller assembly, such that in the retracted position the panel is coiled around the roller assembly.

21. A panel assembly according to claim 1, wherein the locking members are spaced from the flanges by a distance of between 5 mm and 40 mm at rest.

22. A door assembly including:

a) a door curtain movable between a retracted position and an extended position in which the door curtain covers an opening, the door curtain including a plurality of locking members spaced apart along at least part of a length of, and proximate to opposing longitudinal edges of the door curtain, wherein each locking member is a respective deformation of the door curtain; and, b) a guide extending along either side of an opening, each guide including at least one locking flange extending along at least part of a length of the guide, wherein in use the door curtain is received in the guides so that the locking members selectively engage the flanges to limit lateral movement of the door curtain edges; wherein at least one deformation of the panel is in the form of a detent defined by a first surface of the panel, wherein the detent is reflected as a push out on a second surface of the panel, the second surface being opposite the first surface.

* * * * *